US011179754B2

(12) United States Patent
Doucette, Jr. et al.

(10) Patent No.: US 11,179,754 B2
(45) Date of Patent: Nov. 23, 2021

(54) GROUND TANK CLEANING METHOD AND SYSTEM

(71) Applicant: Warrior Technologies, LLC, Midland, TX (US)

(72) Inventors: Billy Lamar Doucette, Jr., Snyder, TX (US); Ryan Dane Hale, Snyder, TX (US); Cooper Sed Wadleigh, Snyder, TX (US); Corey Marvin Longorio, Snyder, TX (US)

(73) Assignee: Warrior Technologies, LLC, Midland, TX (US)

( * ) Notice: Subject to any disclaimer, the term of this patent is extended or adjusted under 35 U.S.C. 154(b) by 113 days.

(21) Appl. No.: 16/125,518

(22) Filed: Sep. 7, 2018

(65) Prior Publication Data

US 2020/0078837 A1 Mar. 12, 2020

(51) Int. Cl.

| | |
|---|---|
| ***B08B 9/08*** | (2006.01) |
| ***B08B 5/04*** | (2006.01) |
| ***B08B 3/02*** | (2006.01) |
| ***A47L 9/06*** | (2006.01) |
| ***A47L 7/00*** | (2006.01) |

(52) U.S. Cl.

CPC ..... *B08B 9/0813* (2013.01); *A47L 7/0009* (2013.01); *A47L 7/0014* (2013.01); *A47L 9/0626* (2013.01); *B08B 3/024* (2013.01); *B08B 5/04* (2013.01); *B08B 9/0808* (2013.01); *B08B 2203/007* (2013.01); *B08B 2209/08* (2013.01)

(58) Field of Classification Search

CPC ..... B08B 9/08; B08B 9/0813; B08B 9/0856; B08B 9/0808; B08B 9/0933; B08B 9/46; B08B 5/04; B08B 2209/08; A47L 9/0626; A47L 9/0009; E03F 7/10

See application file for complete search history.

(56) References Cited

U.S. PATENT DOCUMENTS

| | | | | |
|---|---|---|---|---|
| 5,037,486 | A * | 8/1991 | Sloan | B08B 9/0933 134/113 |
| 5,425,188 | A | 6/1995 | Rinker | |
| 5,584,939 | A * | 12/1996 | Dahlin | B08B 5/02 134/21 |
| 6,547,964 | B1 | 4/2003 | Rajewski | |
| 6,615,849 | B1 | 9/2003 | Gilman et al. | |
| 8,984,709 | B1 * | 3/2015 | Rollins | B08B 9/0933 134/167 R |
| 2003/0147725 | A1 * | 8/2003 | Glass | B08B 9/0933 414/8 |
| 2005/0161372 | A1 * | 7/2005 | Colic | C11D 11/0052 208/391 |

(Continued)

FOREIGN PATENT DOCUMENTS

| | | | | |
|---|---|---|---|---|
| CA | 2745857 | A1 * | 1/2013 | B08B 9/0933 |

*Primary Examiner* — Natasha N Campbell
(74) *Attorney, Agent, or Firm* — Vinson & Elkins LLP

(57) ABSTRACT

A large bore mobile vacuum system is used with special large bore vacuum adapters to enable a method and system for cleaning ground tanks used to store wastewater. The ground tank cleaning method and system may be safer and more efficient that conventional methods by enabling a human operator to physically remain outside of the ground tank, while preventing the contents of the ground tank from being exposed to the environment during the ground tank cleaning.

12 Claims, 8 Drawing Sheets

(56) References Cited

U.S. PATENT DOCUMENTS

| | | | | |
|---|---|---|---|---|
| 2006/0130879 | A1* | 6/2006 | Desormeaux | B08B 9/0933 134/22.18 |
| 2010/0086172 | A1* | 4/2010 | Venkoparao | G06T 7/12 382/100 |
| 2013/0149089 | A1 | 6/2013 | Harms, Jr. et al. | |
| 2017/0058484 | A1 | 3/2017 | Buchleiter et al. | |

* cited by examiner

CLEANING OPERATION WITH A HYDRAULIC EXCAVATOR USING LARGE BORE VACUUM ATTACHMENTS IN A GROUND TANK

GROUND TANK CLEANING METHOD AND SYSTEM

BACKGROUND

Field of the Disclosure

The present disclosure relates generally to cleaning of large ground tanks and, more particularly, to a ground tank cleaning method and system.

Description of the Related Art

Large ground tanks may be used in various industries to hold fluids and slurries from industrial processes, typically at ground level. In the oil and gas industry, for example, certain resource extraction operations, such as fracking, result in a large amount of sedimentary wastewater that is often pumped into storage tanks at surface level (referred to herein as "ground tanks") in proximity to the production site (i.e., wellhead), before being removed in a secondary pumping operation. For these ground tanks in the oil and gas industry, among other similar industries and applications using such ground tanks, the wastewater being extracted from downhole operations and stored in the ground tanks typically has a high sediment content (e.g., sand, shavings, etc.) and can also include certain heavy hydrocarbons (e.g., tars and heavy oils). For example, the wastewater (i.e., wastewater that returns to the surface after hydraulic fracturing fluids are injected into a fracking well) may typically be stored in such ground tanks before permanent disposal or recycling of the wastewater is performed.

As a result of the relatively high fraction of suspended heavy solids and liquids in such wastewater, settling may occur in the ground tank and may result in buildup of significant debris and sediment over time that reduces the effective volume of the ground tank. Because the wastewater is generally pumped out of the tank for disposal, the heavy solids and liquids may remain during pumping and may build up in the ground tank over time. As the tank fills with the heavy solids and liquids, the effective working volume of the tank for storing new wastewater is diminished, thereby reducing the utility of the ground tank for its intended purpose, which is economically and logistically undesirable. Given the scale and production capacity in industries such as the oil and gas industry (e.g., the large number of fracking operations in the United States) and the corresponding large number of ground tanks being relied upon, the reduction of ground tank capacity due to the settling of the heavy solids and liquids represents a significant issue in enabling continued production of hydrocarbons in the oil and gas industry, particularly for fracking wells.

Accordingly, a service industry has arisen to meet the demand for ground tank cleaning services in the oil and gas industry. However, conventional methods and systems for ground tank cleaning may be ineffective, slow, adverse for the environment, and may involve certain health or safety risks to personnel who perform the conventional tank cleaning operations, such as when the personnel physically enter the ground tank for cleaning purposes.

SUMMARY

In one aspect, a vacuum nozzle for ground tank cleaning is disclosed. The vacuum nozzle may include a large bore adapter for a large bore vacuum line having a diameter of at least 8 inches at a first end of the vacuum nozzle. The vacuum nozzle may further include a roller for rolling and pivoting the vacuum nozzle on a surface within the ground tank while in use. In the vacuum nozzle, the roller may be located at a second end of the vacuum nozzle opposite the first end. The vacuum nozzle may further include a nozzle inlet at the second end. In the vacuum nozzle, the nozzle inlet may be wider than the diameter and shorter in height than the diameter.

In any of the disclosed embodiments of the vacuum nozzle, the vacuum nozzle may comprise aluminum.

In any of the disclosed embodiments of the vacuum nozzle, the vacuum nozzle may comprise a fiber composite material. The fiber composite material may be a carbon-fiber composite material.

In any of the disclosed embodiments, the vacuum nozzle may further include a wiper blade attached to at least one edge of the nozzle inlet. The vacuum nozzle further may further include the wiper blade attached to a side of the nozzle inlet. The vacuum nozzle further may further include the wiper blade attached to a leading edge of the nozzle inlet. In the vacuum nozzle, the wiper blade may include a flexible material and may be enabled to wipe the surface when the vacuum nozzle is used at the surface. In the vacuum nozzle, the flexible material comprising the wiper blade may include rubber.

In any of the disclosed embodiments of the vacuum nozzle, the nozzle inlet may correspond to an arc.

In any of the disclosed embodiments of the vacuum nozzle, the nozzle inlet may correspond to a straight line.

In any of the disclosed embodiments, the vacuum nozzle may further comprise a conduit running from the first end to the second end enabled for fluid communication of a pressurized liquid, a coupling in fluid communication with the conduit at the first end, the coupling enabled for connection to a pressurized liquid line, and a spray jet in fluid communication with the conduit at the second end for spraying the pressurized liquid.

In any of the disclosed embodiments, the vacuum nozzle may further comprise a plurality of spray jets in fluid communication with the conduit at the second end. In the vacuum nozzle, the pressurized liquid may be water. In the vacuum nozzle, the pressurized liquid may be heated to at least 40° C.

In another aspect, a method for cleaning ground tanks used for wastewater storage is disclosed. The method may include positioning a large bore mobile vacuum system in proximity to a ground tank indicated for cleaning, the large bore mobile vacuum system including a vacuum line, and attaching a large bore vacuum nozzle to the vacuum line. The method may also include guiding the large bore vacuum nozzle through a tank wall of the ground tank into the ground tank. In the method, the vacuum line may be physically manipulated by an operator located outside of the ground tank. The method may also include using the large bore vacuum nozzle to clean within the ground tank. In the method, at least one of liquid material and solid material may be removed from within the ground tank using the vacuum line.

In any of the disclosed embodiments, the method may further include attaching a large bore extension adapter to the large bore vacuum nozzle. In the method, the large bore extension adapter and the large bore vacuum nozzle may be made of aluminum.

In any of the disclosed embodiments of the method, positioning the large bore mobile vacuum system may further include positioning the large bore mobile vacuum system in proximity to the ground tank using a first vehicle.

In any of the disclosed embodiments, the method may further include connecting a pressurized fluid line to a conduit attached to the large bore vacuum nozzle, and controlling a volume of discharge of the pressurized fluid from a spray jet in fluid communication with the conduit by applying pressure to the pressurized fluid. In the method, the spray jet may be directed by the large bore vacuum nozzle when the large bore vacuum nozzle is used to clean the ground tank.

In any of the disclosed embodiments, the method may further include collecting the liquid material and the solid material in a first holding tank of the large bore mobile vacuum system.

In any of the disclosed embodiments, the method may further include draining the first holding tank into a second holding tank, wherein the second holding tank is mobile In the method, the second holding tank may be located on a second vehicle.

In any of the disclosed embodiments, the method may further include connecting a pressurized fluid line to a conduit attached to the large bore vacuum nozzle, and controlling a volume of discharge of the pressurized fluid from a spray jet in fluid communication with the conduit by applying pressure to the pressurized fluid, wherein the spray jet is directed by the large bore vacuum nozzle when the large bore vacuum nozzle is used to clean the ground tank.

In any of the disclosed embodiments of the method, using the large bore vacuum nozzle to clean the ground tank may further include at least one of: rolling the large bore vacuum nozzle on a surface within the ground tank using a roller attached to the large bore vacuum nozzle, and wiping the surface using a wiper blade attached to the large bore vacuum nozzle.

In any of the disclosed embodiments of the method, the surface may be at a tank wall of the ground tank.

In any of the disclosed embodiments of the method, the surface may be a foundation of the ground tank.

In any of the disclosed embodiments of the method, the surface may be a sediment layer in the ground tank.

In any of the disclosed embodiments of the method, guiding the large bore vacuum nozzle through a tank wall of the ground tank into the ground tank may further include acquiring an infrared image of the ground tank, and, based on the infrared image, determining a location in the tank wall for guiding the large bore vacuum through the tank wall.

In yet another aspect, a second vacuum nozzle for ground tank cleaning is disclosed. The second vacuum nozzle may include a large bore adapter for a large bore vacuum line having a diameter of at least 8 inches at a first end of the second vacuum nozzle. The second vacuum nozzle may further include a nozzle inlet at a second end of the vacuum nozzle opposite the first end. In the second nozzle, the nozzle inlet may be wider than the diameter and shorter in height than the diameter. The second vacuum nozzle may further include a wiper blade attached to at least one edge of the nozzle inlet.

In any of the disclosed embodiments of the second vacuum nozzle, the second vacuum nozzle may comprise aluminum.

In any of the disclosed embodiments of the second vacuum nozzle, the second vacuum nozzle may comprise a fiber composite material. The fiber composite material may be a carbon-fiber composite material.

In any of the disclosed embodiments, the second vacuum nozzle may further comprise a roller for rolling and pivoting the second vacuum nozzle on a surface within the ground tank while in use. In the second vacuum nozzle, the roller may be located at a second end of the second vacuum nozzle opposite the first end.

In any of the disclosed embodiments, the second vacuum nozzle further may further comprise the wiper blade attached to a side of the nozzle inlet. The second vacuum nozzle further may further comprise the wiper blade attached to a leading edge of the nozzle inlet. In the second vacuum nozzle, the wiper blade may comprise a flexible material and may be enabled to wipe the surface when the second vacuum nozzle is used at the surface. In the second vacuum nozzle, the flexible material comprising the wiper blade may include rubber.

In any of the disclosed embodiments of the second vacuum nozzle, the surface may be at a tank wall of the ground tank.

In any of the disclosed embodiments of the second vacuum nozzle, the surface may be a foundation of the ground tank.

In any of the disclosed embodiments of the second vacuum nozzle, the surface may be a sediment layer in the ground tank.

In any of the disclosed embodiments of the second vacuum nozzle, the nozzle inlet may correspond to an arc.

In any of the disclosed embodiments of the second vacuum nozzle, the nozzle inlet may correspond to a straight line.

In any of the disclosed embodiments, the second vacuum nozzle may further comprise a conduit running from the first end to the second end enabled for fluid communication of a pressurized liquid, a coupling in fluid communication with the conduit at the first end, the coupling enabled for connection to a pressurized liquid line, and a spray jet in fluid communication with the conduit at the second end for spraying the pressurized liquid.

In any of the disclosed embodiments, the second vacuum nozzle may further comprise a plurality of spray jets in fluid communication with the conduit at the second end. In the second vacuum nozzle, the pressurized liquid may be water. In the second vacuum nozzle, the pressurized liquid may be heated to at least 40° C.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
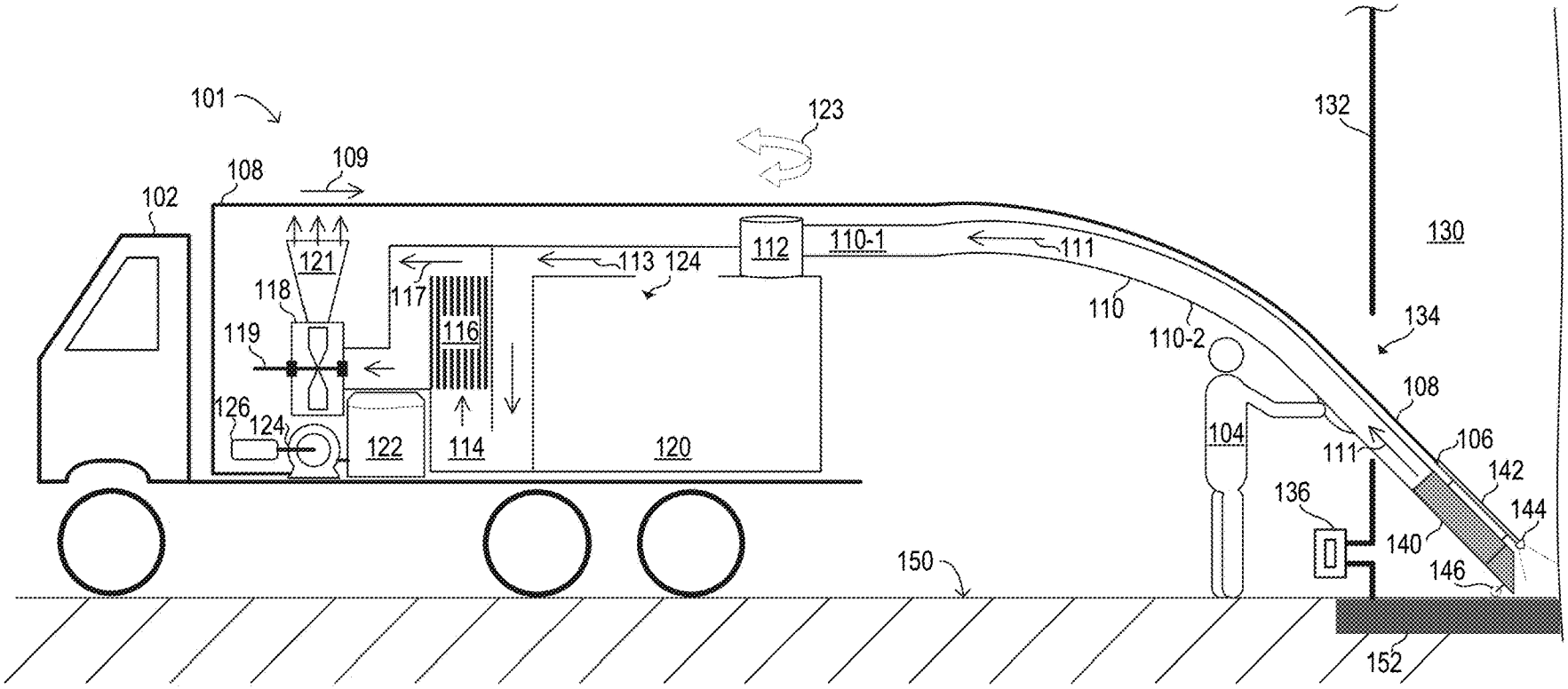
FIG. 1 is a block diagram of selected elements of an embodiment of a mobile vacuum system using large bore attachments for ground tank.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

As noted previously, conventional methods of ground tank cleaning may be ineffective, inefficient and may pose certain risks to the environment and personnel, due to exposure to the residual contents of the ground tank. For example, when the ground tank is used to store wastewater from a fracking well, the residual contents may include various kinds of liquid material and solid material that may have unacceptable levels of toxicity. The liquid material may include heavy oils, tar, grease, downhole mud, among various types of hydrocarbon fractions or residue, while the solid material may include rock fragments, sand, shavings, and various other types of sediments. Conventional methods of ground tank cleaning may use relatively small bore vacuum lines (i.e., about 4 inches in diameter or smaller) that are manually operated, while at least some of the contents of the ground tank are often released on the ground for cleaning and removal, which is undesirable due to the environmental exposure of the liquid material and solid material remaining in the ground tank. Furthermore, human operators of the small bore vacuum lines typically enter the ground tank with the small bore vacuum line and work inside the ground tank, which is also undesirable from a safety and occupational health perspective. Further, the use of small bore vacuum lines may often be subject to partial and complete clogging, which may reduce the rate of removal of the liquid material and the solid material in the ground tank, making the conventional cleaning operation inefficient and ineffective. Because of the relatively small bore vacuum lines used with conventional ground tank cleaning methods, the rate of removal of the liquid material and the solid material in the ground tank may be physically constrained by the small bore diameter that limits an amount of suction force and flow volume that can be effectively used.

As will be described in further detail herein, a ground tank cleaning method and system is disclosed that uses a large bore vacuum line having a diameter of at least 8 inches, along with corresponding vacuum nozzles that may be directly attached to the large bore vacuum line using a large bore adapter. In some implementations of the ground tank cleaning method and system disclosed herein, a vacuum nozzle used with a large bore vacuum line may be equipped with a roller for rolling and pivoting the vacuum line while in use inside the ground tank. In some implementations of the ground tank cleaning method and system disclosed herein, a vacuum nozzle used with a large bore vacuum line may be equipped with a wiper blade attached to an edge of the vacuum nozzle. In the ground tank cleaning method and system disclosed herein, the vacuum nozzle and one or more large bore extension adapters used on the vacuum line may be made of a lightweight material, such as aluminum or a fiber-based composite material, to enable manual manipulation and operation of the vacuum line. In some implementations of the ground tank cleaning method and system disclosed herein, the vacuum nozzle may include a conduit in fluid communication with a spray jet for spraying a pressurized liquid, such as water, to dislodge some of the solid material and more viscous liquid material in the ground tank to enable collection with the vacuum nozzle.

In the ground tank cleaning method and system disclosed herein, the vacuum nozzle, and optionally one or more large bore extension adapters, may enable a human operator to guide the large bore vacuum nozzle through a tank wall of the ground tank into the ground tank, while the operator remains outside of the ground tank when the large bore vacuum nozzle is used to remote the liquid material and the solid material within the ground tank. In the ground tank cleaning method and system disclosed herein, in order to leverage the larger vacuum line volume and cross-sectional area of the large bore vacuum line, a mobile vacuum system may be used as a large bore vacuum source to provide sufficient vacuum force and to maintain a sufficient vacuum flow rate. In the ground tank cleaning method and system disclosed herein, the mobile vacuum system may be positioned in proximity to the ground tank using a first vehicle on which the mobile vacuum system is located. For ground tanks having larger volumes of liquid material and solid material to be cleaned, a second holding tank may be used to drain a first holding tank of the mobile vacuum system, enabling continuous operation of the ground tank cleaning method and system disclosed herein. In some cases, the second holding tank may be located on a second vehicle, such as a trailer or a truck, that can be used to position the second holding tank. Accordingly, the second holding tank may also be a mobile tank.

Referring now to the drawings, FIG. 1 illustrates an example embodiment of a cleaning operation 100 with a mobile vacuum system 101 using a large bore vacuum attachment 140 in a ground tank 130. FIG. 1 is a schematic illustration for descriptive purposes and is not necessarily drawn to scale or perspective. In FIG. 1, elements are depicted on a ground surface 150 that may represent any foundational surface. Although ground surface 150 is shown as a flat surface, it will be understood that ground surface 150 may typically be contoured to some extent, and may include, for example, a runoff basin (not shown) in which ground tank 130 is located, such that the runoff basin collects wastewater escaping from ground tank 130. Furthermore, although a single operator 104 is shown performing cleaning operation 100, it will be understood that other personnel may also be additionally engaged for cleaning operation 100.

In FIG. 1, ground tank 130, shown in cross-section, is illustrated comprising a tank wall 132 that is built in fluid communication on a foundation 152 that is built on ground surface 150. It will be understood that ground tank 130 may be of various diameters and heights and that dimensions of ground tank 130 do not constrain any of the ground tank cleaning methods and systems disclosed herein. As shown, ground tank 130 also includes an external drain 136 that may be used to drain the contents of ground tank 130 onto ground surface 150. Further, tank wall 132 is shown having a service opening 134, which may be one of a number of service openings that may be externally sealed using a corresponding hatch (not shown) that is removable to access the interior of ground tank 130. It is noted that different instances of service opening 134 may be located at different locations or heights at tank wall 132.

In FIG. 1, mobile vacuum system 101 is shown in a working position for cleaning operation 100. Because mobile vacuum system 101 is built on and integrated with a first vehicle 102, mobile vacuum system 101 is mobile and can be driven to a desired location. As shown, first vehicle 102 may be a flat-bed (or bedless) truck on which various systems and associated components have been installed and included for use.

In FIG. 1, a first system included with mobile vacuum system 101 is a large bore vacuum system that is powered using a first shaft 119 that turns an air blower 118 that pulls clean air 117 in and sends out clean exhaust air via a muffler 121 to the environment. In some embodiments, a secondary motor or secondary engine (not shown) included with mobile vacuum system 101 may be used to power first shaft 119. In particular embodiments, first shaft 119 may be selectively coupled to a primary engine (not shown) of first vehicle 102 to drive air blower 118. For example, first shaft 119 may be selectively coupled to a transmission of the primary engine using corresponding mechanical coupling (not shown) to enable the primary engine to be used for powering mobile vacuum system 101 while first vehicle 102 is stationery. Such an arrangement may be particularly advantageous in saving weight and equipment costs of mobile vacuum system 101 and leveraging the relatively high power output of the primary engine, which is typically a diesel engine having several hundred horsepower, for mobile vacuum system 101. Air blower 118 accordingly provides the vacuum power suction and flow rate for a large bore vacuum line 110 that receives large bore vacuum nozzle 140. Specifically, clean air 117 may be filtered using a filter stage 116 that receives dirty air 113 via a conduit chamber 114. Filter stage 116 may represent any of a variety of air filters, air filter stages, or other means to remove particulates, dirt, aerosols, contaminants, toxins, gases, dust, or other airborne contaminants from dirty air 113. It is noted that filter stage 116 may incorporate removable filter elements or cartridges, which may be successively arranged in stages from coarse filtration to fine filtration, as desired.

In FIG. 1, dirty air 113 is leftover at a first holding tank 120 when waste material 111 arrives at a turret 112 that couples large bore vacuum line 110 to first holding tank 120 and may enable vacuum line 110 to rotate horizontally about first holding tank 120 as shown by horizontal angular rotation arrows 123. In some implementations, vacuum line 110 may include a first portion 110-1 that may be a rigid portion, such as a large bore pipe that is fixed to turret 112, and may further be supported by a boom arm (not shown) that may also be fixed to turret 112 to facilitate rotation of vacuum line 110 in an extended horizontal position at the top of first holding tank 120. Further, vacuum line 110 may include a second portion 110-2 that is a flexible portion, such as a flexible hose or an articulated conduit, that may be enabled to receive vacuum nozzle 140 (or another large bore vacuum attachment, as disclosed herein) at a distal end of vacuum line 110.

Thus, in FIG. 1, waste material 111 (i.e., the liquid material and solid material from ground tank 130) along with dirty air 113 that is sucked in by vacuum nozzle 140 travels through second portion 110-2 to first portion 110-1 and then through turret 112. As waste material 111 exits turret 112, the liquid material and solid material (not shown) pass through a trap opening 124, as shown, and are collected in first holding tank 120, while dirty air remains in conduit chamber 114 and is sucked through filter stage 116, as explained above. Thus, as mobile vacuum system 101 is used to remove waste material 111, first holding tank 120 may fill with the liquid material and solid material from ground tank 130, while dirty air 113 is filtered by filter stage 116 and is released as clean exhaust air via muffler 121 to the environment.

In FIG. 1, a second system included with mobile vacuum system 101 is a pressurized fluid system that shown powered using a motor 126 that turns a compressor 124 that receives fluid from a clean fluid tank 122 and sends the pressurized fluid through a pressure line 108. In typical embodiments, the pressurized fluid is water and is pre-filled in clean fluid tank 122 prior to arrival of mobile vacuum system 101 at ground tank 130 for cleaning, as described herein. It will be understood that other liquids besides water, such as fluid mixtures or fluid solutions, may be used in clean fluid tank 122. Furthermore, it will be understood that the pressurized fluid used may be heated, such as using a heater (not shown) along pressure line 108 or by heating clean fluid tank 122 to a desired temperature, to deliver the pressurized fluid at an elevated temperature. As shown, pressure line 108 runs from first vehicle 102 to vacuum line 110 and may be coupled to a conduit 142 included with vacuum nozzle 140 using a coupling 106. At an opposite end of conduit 142 from coupling 106, a spray jet 144 may be mounted on vacuum nozzle 140 to deliver the pressurized fluid using vacuum nozzle 140 to direct spray jet 144.

Also shown in FIG. 1 with vacuum nozzle 140 is a roller 146 that is mounted on vacuum nozzle 140 to enable rolling and pivoting of vacuum nozzle 140 on a surface, for example foundation 152 or side wall 132, within the ground tank while vacuum nozzle is use.

In conventional methods of cleaning ground tank 130, a relatively small bore vacuum or vacuums are used. The conventional method of cleaning ground tank 130 may begin by first opening external drain 136, and then allowing the liquid material and solid material in ground tank 130 to spill out onto ground 150, from where the liquid material and the solid material are then vacuumed up using the small bore vacuum(s). Because this method releases the liquid and solid material to the open environment, undesired contamination of at least the surrounding area around ground tank 130 may occur, which is undesirable. Then, in a second step, the conventional method of cleaning ground tank 130 may involve an operator 104 physically entering ground tank 130, to collect and direct the liquid material and the solid material towards external drain 136. Because external drain 136 is often also a small bore opening, the small bore vacuum may be then used to suck out the remaining liquid and solid material from within ground tank 130. As noted previously, the entry of personnel, such as operator 104, within ground tank 130 is undesirable due to safety and occupational health risks that may be associated with contact with the liquid material and solid material, as well as due to the air quality within ground tank 130.

In cleaning operation 100, external drain 136 may remain closed and service opening 134 can be initially accessed as the first entry to the interior of ground tank 130 without spilling any of the liquid material and solid material in ground tank 130 on ground 150. Then, large bore vacuum nozzle 140 may be attached to vacuum line 110, as shown. It will be understood that any of a variety of different large bore vacuum nozzles, as described herein, may be used with vacuum line 110. Then, with operator 104 standing outside of ground tank 130, vacuum nozzle 140 may be guided through service opening 134 in tank wall 132 to reach the interior of ground tank 130. Then, with operator 104 still standing outside of ground tank 130 at service opening 134, vacuum nozzle 140 may be used to clean within ground tank 130, to remove the liquid material, the solid material, or both. Depending on the amount of debris present within ground tank 130, the liquid material and the solid material may be removed by vacuuming in the center of ground tank 130, at foundation 152 of ground tank 130, or along and interior surface of side wall 132 of ground tank 130.

As cleaning operation 100 progresses, and more and more of the liquid material and solid material is removed from ground tank 130, the liquid material and the solid material, as well as any of the pressurized fluid that might have been sprayed into ground tank 130, accumulates in first storage tank 120. As first storage tank 120 reaches capacity, a second vehicle (not shown) having a second storage tank may be positioned in proximity to first vehicle 120, and the contents of first storage tank 120 may then be pumped into the second storage tank. The pumping and draining of first storage tank 120 may be repeated as many times as indicated during cleaning operation 100. It will be understood that as the second storage tank is filled, the second storage tank may be removed for disposal and replaced with yet another vehicle carrying yet another storage tank for draining first storage tank 120.

As more and more of the interior portion of ground tank 130 is cleaned and the liquid material and the solid material is removed, additional large bore vacuum extensions may be used to extend the reach of vacuum nozzle 140 by operator 104. In this manner, operator 104 can remain outside ground tank 130, while cleaning out the interior volume within ground tank 130. Because vacuum nozzle 140 and the additional large bore vacuum extensions are manipulated manually by operator 104, the weight of the aggregate vacuum line supported by the operator is an important consideration. If vacuum nozzle 140 and the additional large bore vacuum extension are made from a too heavy material, for example, steel or stainless steel, the weight of the vacuum line may be too great for operator 104 to manipulate manually. Therefore, vacuum nozzle 140 and the additional large bore vacuum extensions may be made from a lightweight, yet strong, material, such as aluminum. In some implementations, vacuum nozzle 140 and the additional large bore vacuum extensions may be made from a fiber-reinforced composite material, such as a carbon-fiber composite material.

In the manner described above, cleaning operation 100 may restore a large operational storage volume within ground tank 130, which is economically desirable for the usage of ground tank 130 to store wastewater from oil and gas extraction operations.

Figure 2:
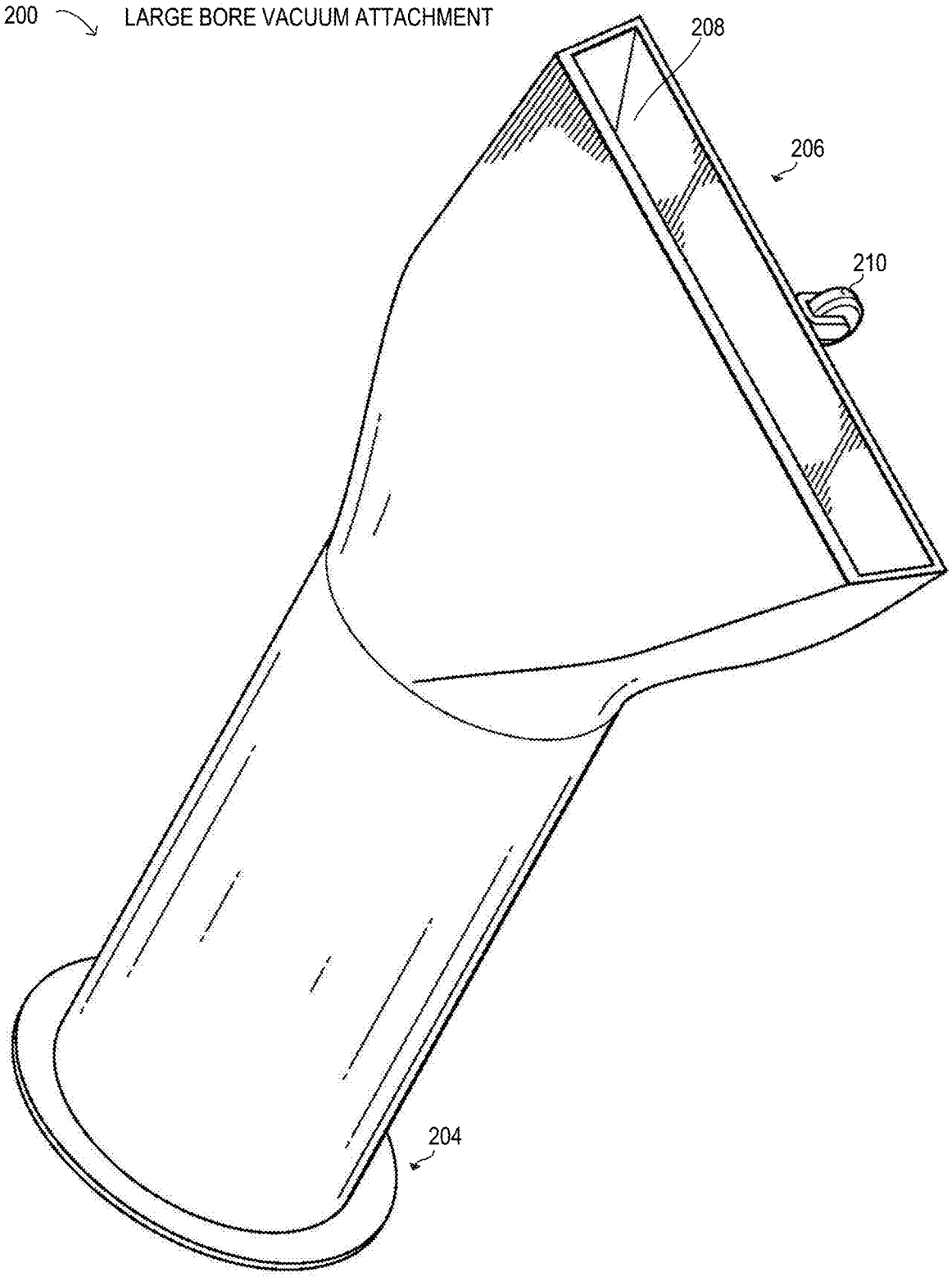
FIG. 2 is a depiction of an embodiment of a large bore vacuum attachment.

Referring now to FIG. 2, a depiction of an embodiment of a large bore vacuum attachment 200 is shown. Large bore vacuum attachment 200 may represent an embodiment of large bore vacuum nozzle 140 shown in FIG. 1. In FIG. 2, large bore vacuum attachment 200 is shown in a perspective view as a schematic illustration that may not be precisely drawn to scale. As shown, large bore vacuum attachment 200 is a flared vacuum nozzle having a large bore vacuum adapter at a first end 204. The large bore vacuum adapter may be at least 8 inches in diameter. In particular implementations, the diameter of the large bore vacuum adapter may be about 8 inches, about 10 inches, about 12 inches, or greater than 12 inches. At a second end 206 of large bore vacuum attachment 200 opposite first end 204, the flared nozzle may terminate in a nozzle inlet 208 that is open to facilitate vacuum suction of the liquid material and the solid material within ground tank 130. Nozzle inlet 208 may be greater than the diameter of the large bore vacuum attachment in width (i.e., wider), and may be smaller than the diameter in height (i.e., shorter). As shown in FIG. 2, nozzle inlet 208 may generally correspond to a straight line in contour or shape. Also visible in FIG. 2 is a roller 210, which may assist in supporting large bore vacuum attachment 200 on a surface within ground tank 130, such as on foundation 152.

Figure 3:
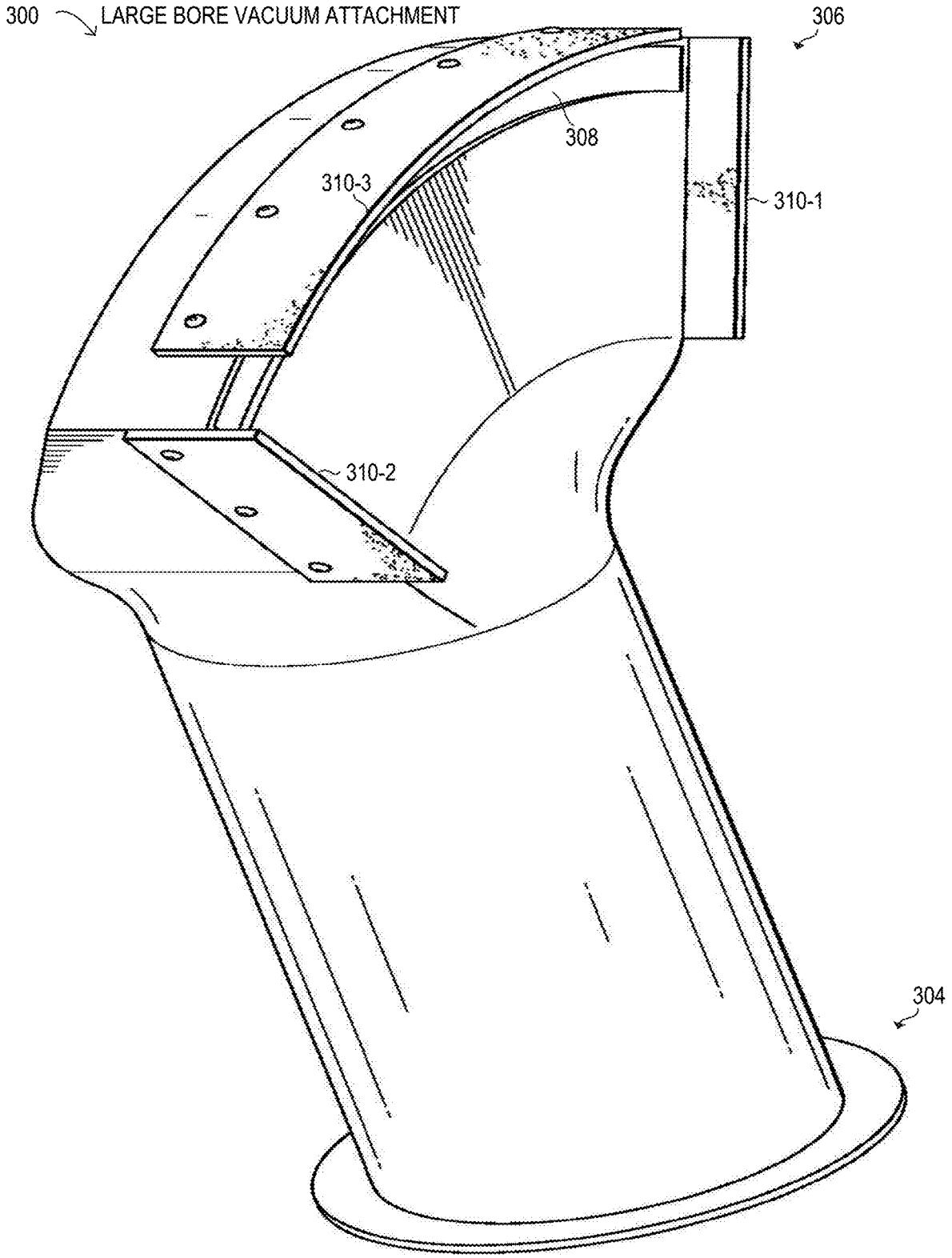
FIG. 3 is a depiction of an embodiment of a large bore vacuum attachment.

Referring now to FIG. 3, a depiction of an embodiment of a large bore vacuum attachment 300 is shown. Large bore vacuum attachment 300 may represent an embodiment of large bore vacuum nozzle 140 shown in FIG. 1. In FIG. 3, large bore vacuum attachment 300 is shown in a perspective view as a schematic illustration that may not be precisely drawn to scale. As shown, large bore vacuum attachment 300 is a flared vacuum nozzle having a large bore vacuum adapter at a first end 304. At a second end 306 of large bore vacuum attachment 300 opposite first end 304, the flared nozzle may terminate in a nozzle inlet 308 that is open to facilitate vacuum suction of the liquid material and the solid material within ground tank 130. Nozzle inlet 308 may be greater than the diameter of the large bore vacuum attachment in width (i.e., wider), and may be smaller than the diameter in height (i.e., shorter). As shown in FIG. 2, nozzle inlet 308 may generally correspond to an arc in contour or shape. Also visible in FIG. 2 is a wiper blade 310 that may be attached to at least one edge of nozzle inlet 308. In particular implementations, wiper blade 308 may be implemented as multiple pieces, for example, as wiper blades 310-1, 310-2 at side edges of nozzle inlet 308, or for example as wiper blade 310-3 that is mounted at a leading edge of nozzle inlet 308. In various implementations, wiper blade 310 may be formed from a flexible material that enables wiping of an interior surface of ground tank 130. Accordingly, the flexible material used for wiper blade 310 may comprise rubber or another natural or synthetic elastomer. In particular implementations, wiper blade 310 may comprise a hard rubber having a thickness between ¼" and ½", for example.

Figure 4:
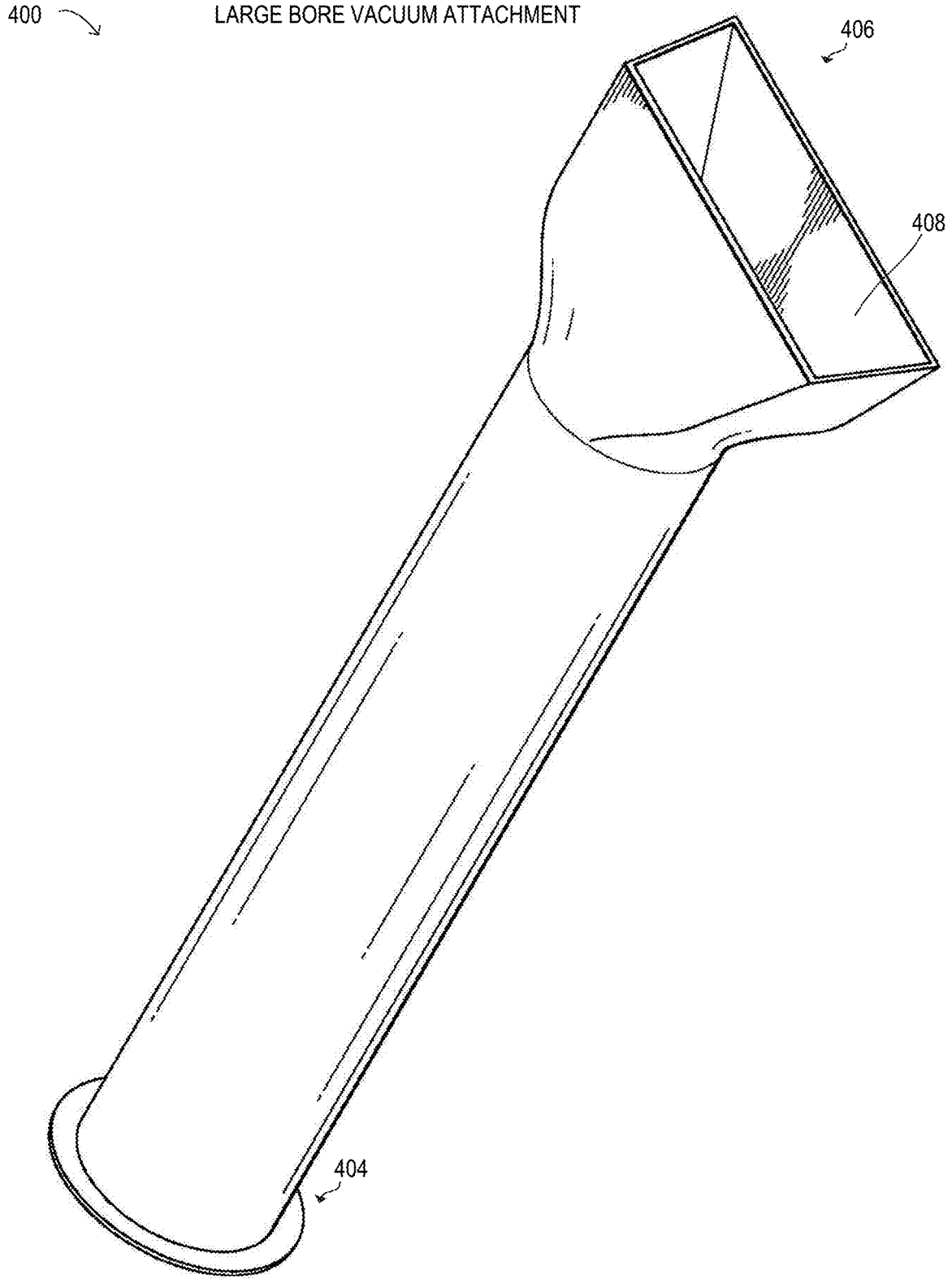
FIG. 4 is a depiction of an embodiment of a large bore vacuum attachment.

Referring now to FIG. 4, a depiction of an embodiment of a large bore vacuum attachment 400 is shown. Large bore vacuum attachment 400 may represent an embodiment of large bore vacuum nozzle 140 shown in FIG. 1. In FIG. 4, large bore vacuum attachment 400 is shown in a perspective view as a schematic illustration that may not be precisely drawn to scale. As shown, large bore vacuum attachment 400 is a flared box vacuum nozzle having a long large bore vacuum adapter at a first end 404. At a second end 406 of large bore vacuum attachment 400 opposite first end 404, the flared box nozzle may terminate in a nozzle inlet 408 that is open to facilitate vacuum suction of the liquid material and the solid material within ground tank 130. Nozzle inlet 408 may be greater than the diameter of the large bore vacuum attachment in width (i.e., wider), and may be smaller than the diameter in height (i.e., shorter). As shown in FIG. 4, nozzle inlet 408 may generally correspond to a straight line or a plane in contour or shape. Although not shown in FIG. 4, it will be understood that large bore vacuum attachment 400 may incorporate at least one of a roller, a wiper, and a conduit with a spray jet for a pressurized fluid, as described herein.

Figure 5:
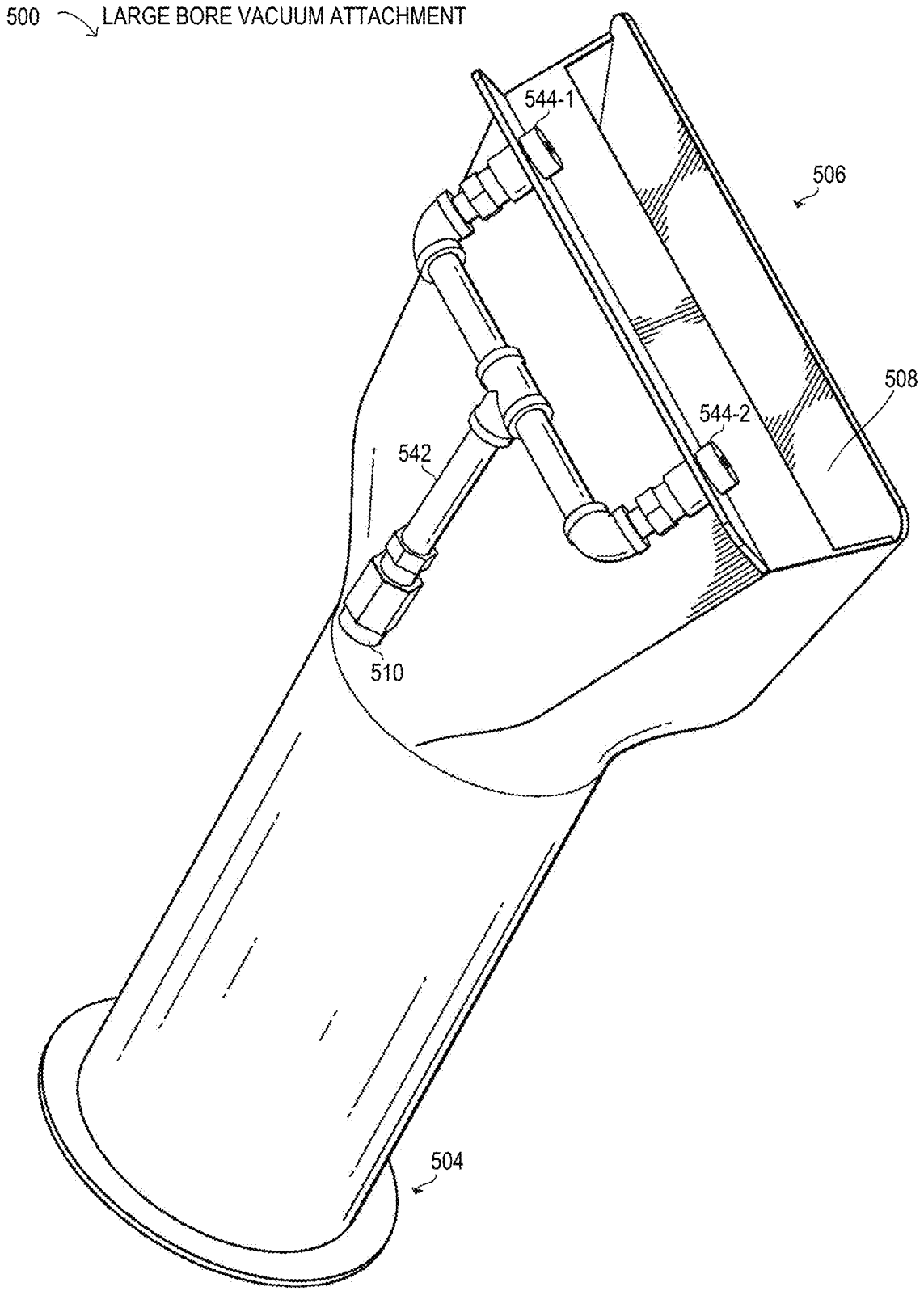
FIG. 5 is a depiction of an embodiment of a large bore vacuum attachment.

Referring now to FIG. 5, a depiction of an embodiment of a large bore vacuum attachment 500 is shown. Large bore vacuum attachment 500 may represent an embodiment of large bore vacuum nozzle 140 shown in FIG. 1. In FIG. 5, large bore vacuum attachment 500 is shown in a perspective view as a schematic illustration that may not be precisely drawn to scale. As shown, large bore vacuum attachment 500 is a flared vacuum nozzle having a long large bore vacuum adapter at a first end 504. At a second end 506 of large bore vacuum attachment 500 opposite first end 504, the flared nozzle may terminate in a nozzle inlet 508 that is open to facilitate vacuum suction of the liquid material and the solid material within ground tank 130. Nozzle inlet 508 may be greater than the diameter of the large bore vacuum attachment in width (i.e., wider), and may be smaller than the diameter in height (i.e., shorter). As shown in FIG. 5, nozzle inlet 508 may generally correspond to a straight line or a plane in contour or shape. Also shown in FIG. 5 is a conduit 542 with two spray jets 544-1, 544-2 to enable spraying of a pressurized fluid, as described previously. Conduit 542 includes fluid coupling 510 that can couple to a pressurized fluid line, such as pressure line 108 shown in FIG. 1. In large bore vacuum attachment 500, nozzles 544 are mounted on a flange adjacent to nozzle inlet 508 that enable direction of nozzles 544 towards the liquid material and the solid material within ground tank 130 by directing and manipulating large bore vacuum attachment 300. In this manner, nozzles 544 can spray the pressurized fluid (e.g., clean water) towards hardened or dried material to loosen and dissolve the material to enable removal by suction at nozzle inlet 508.

Figure 6:
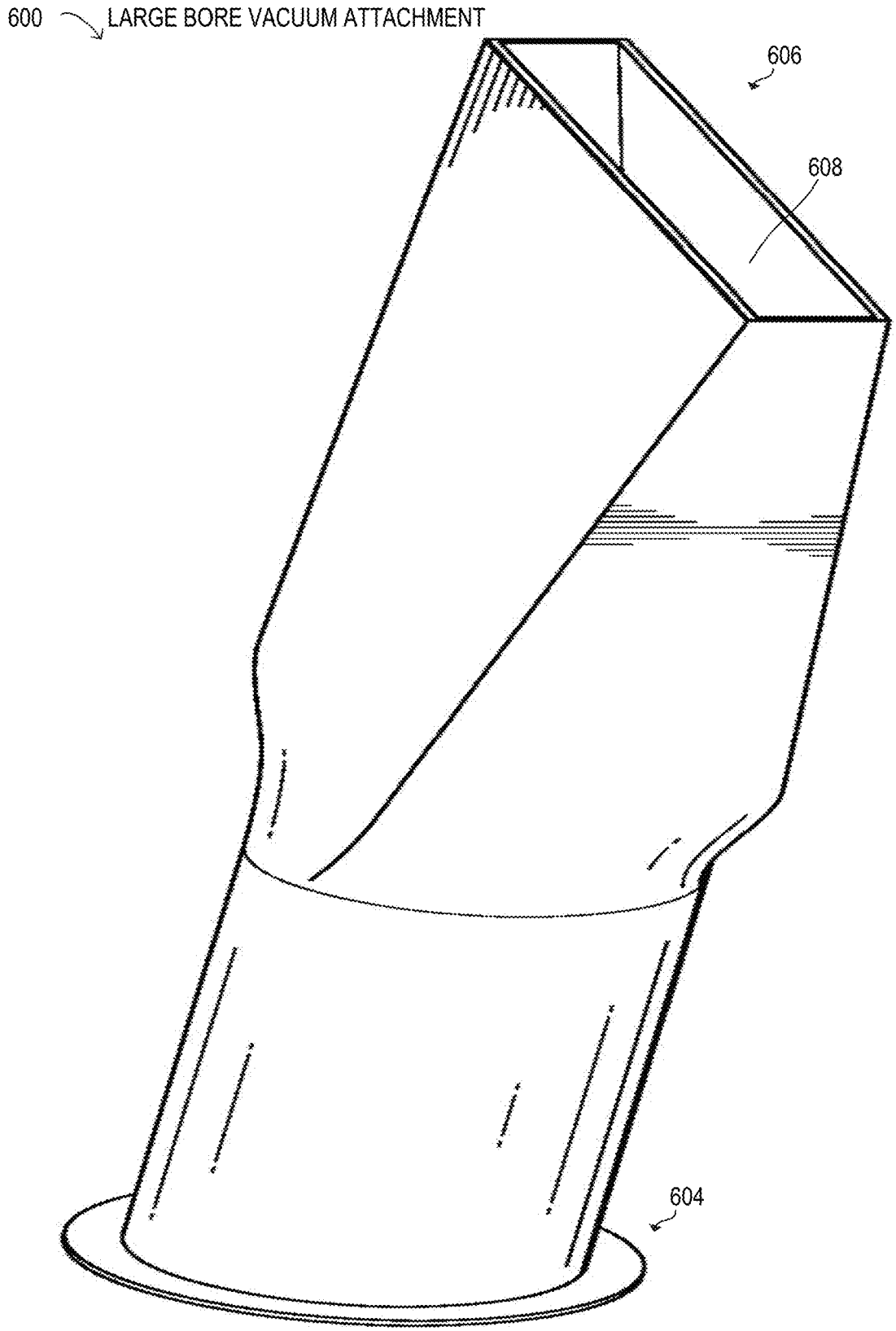
FIG. 6 is a depiction of an embodiment of a large bore vacuum attachment.

Referring now to FIG. 6, a depiction of an embodiment of a large bore vacuum attachment 600 is shown. Large bore vacuum attachment 600 may represent an embodiment of large bore vacuum nozzle 140 shown in FIG. 1. In FIG. 6, large bore vacuum attachment 600 is shown in a perspective view as a schematic illustration that may not be precisely drawn to scale. As shown, large bore vacuum attachment 600 is a flared vacuum nozzle having a long large bore vacuum adapter at a first end 604. At a second end 606 of large bore vacuum attachment 600 opposite first end 604, the flared nozzle may terminate in a nozzle inlet 608 that is open to facilitate vacuum suction of the liquid material and the solid material within ground tank 130. Nozzle inlet 608 may be greater than the diameter of the large bore vacuum attachment in width (i.e., wider), and may be smaller than the diameter in height (i.e., shorter). As shown in FIG. 6, nozzle inlet 608 may generally correspond to a straight line or a plane in contour or shape. Although not shown in FIG. 6, it will be understood that large bore vacuum attachment 600 may incorporate at least one of a roller, a wiper, and a conduit with a spray jet for a pressurized fluid, as described herein.

Figure 7:
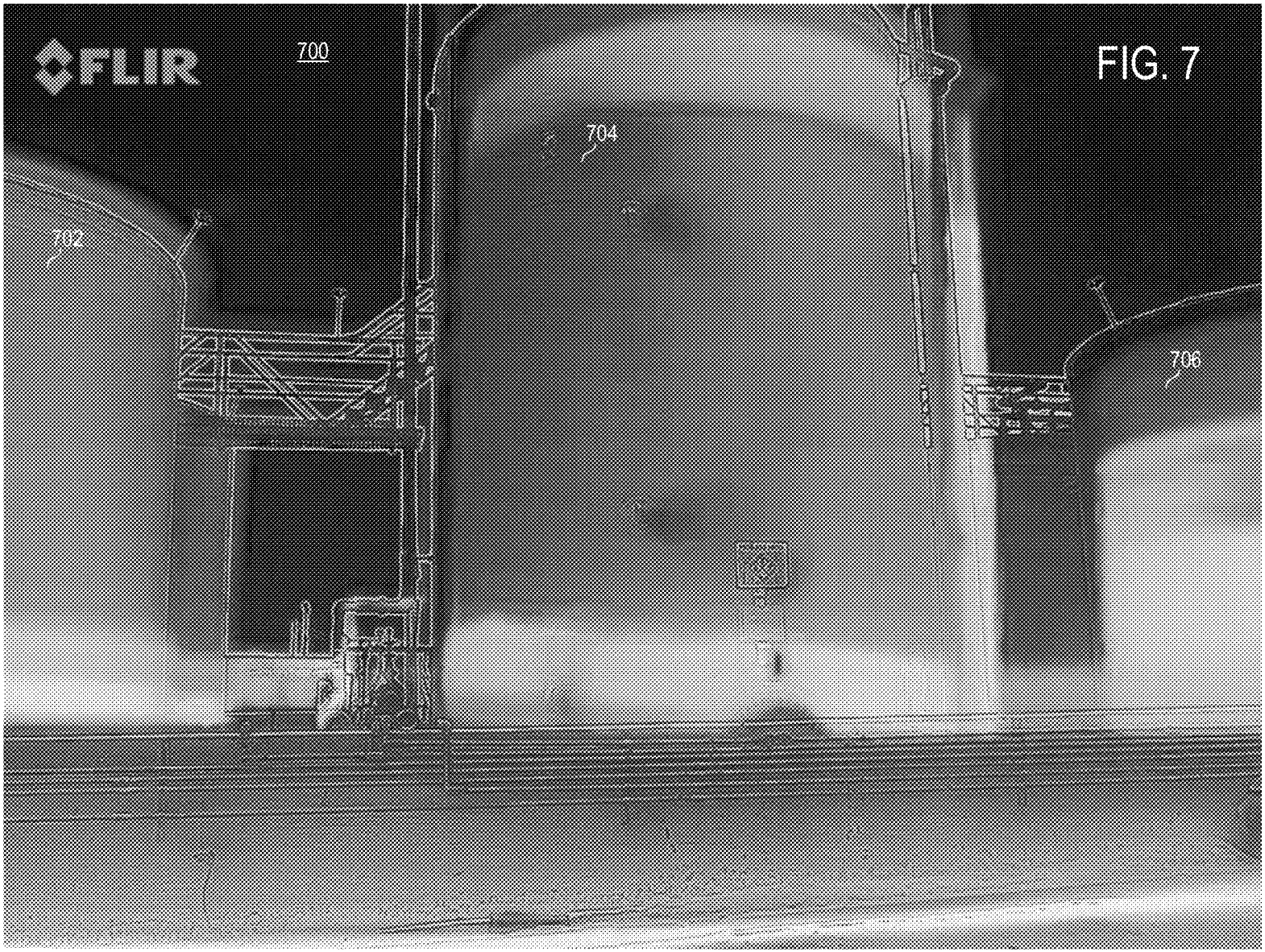
FIG. 7 is an infrared image of three ground tanks.

Referring now to FIG. 7, an infrared image 700 of three ground tanks 702, 704, 706 is shown. Because the liquid material and the solid material within a ground tank will have a different heat capacity and thermal conductivity as air, the liquid material and the solid material will respond different to thermal loading, such as daily outdoor temperature fluctuations. As a result, the liquid material and the solid material may exhibit a temperature different to the air within the ground tank. Accordingly, this temperature difference may be made visible using an infrared camera to generate an image sensitive to infrared light or heat (i.e., infrared image 700). Thus, in FIG. 7, the interior contents of each ground tank are visible as lighter regions in infrared image 700. For example, it can be observed from infrared image 700 that ground tanks 702 and 704 have relatively low residual contents, while ground tank 706 has relatively high residual contents.

In particular implementations, the use of infrared image 700 may enable planning of cleaning operation 100 to clean ground tank 130 (see FIG. 1). For example, depending on a residual content level within ground tank 130, or on an asymmetry of the residual content, a decision may be made where or how to enter ground tank 130 for cleaning operation 100. Alternatively, if a large amount of liquid material is observed within ground tank 130, pumping off of the liquid material may be performed before cleaning operation 100 is started.

Figure 8:
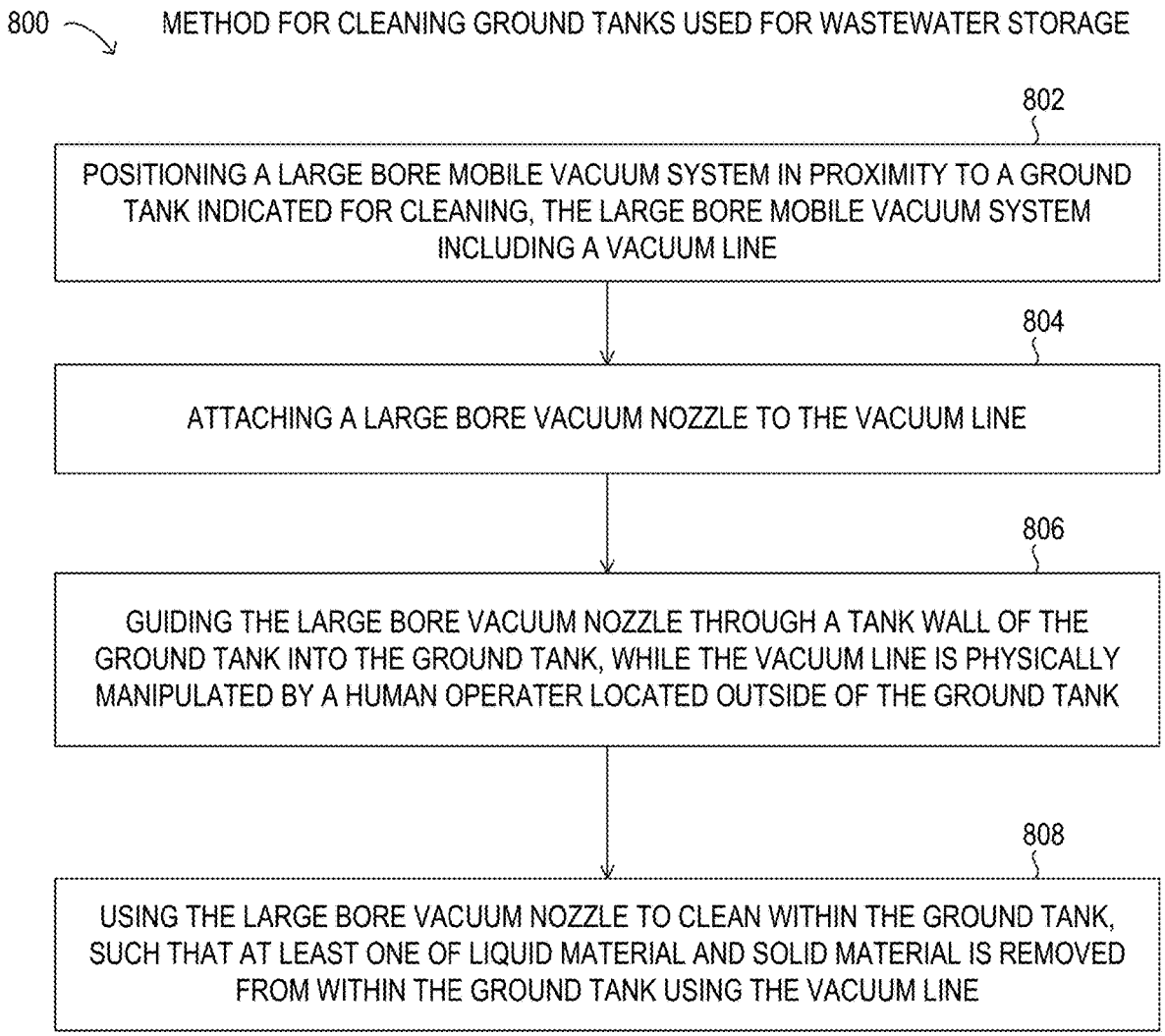
FIG. 8 is a flowchart of selected elements of an embodiment of a method for cleaning ground tanks used for wastewater storage.

Referring now to FIG. 8, a flowchart of selected elements of an embodiment of method 800 for cleaning ground tanks used for wastewater storage as described herein, is depicted. Method 800 may be performed in the context of cleaning operation 100, as described above with respect to FIG. 1. It is noted that certain operations described in method 800 may be optional or may be rearranged in different embodiments.

Method 800 may begin at step 802 by positioning a large bore mobile vacuum system in proximity to a ground tank indicated for cleaning, the large bore mobile vacuum system including a vacuum line. At step 804, a large bore vacuum nozzle is attached to the vacuum line. At step 806, the large bore vacuum nozzle is guided through a tank wall of the ground tank into the ground tank, while the vacuum line is physically manipulated by a human operator located outside of the ground tank. At step 808, the large bore vacuum nozzle is used to clean within the ground tank, such that at least one of liquid material and solid material is removed from within the ground tank using the vacuum line.

As disclosed herein, a large bore mobile vacuum system is used with special large bore vacuum adapters to enable a method and system for cleaning ground tanks used to store wastewater. The method and system may be safer and more efficient that conventional methods by enabling a human operator to physically remain outside of the ground tank, while preventing the contents of the ground tank from being exposed to the environment during cleaning.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method for cleaning ground tanks used for wastewater storage, the method comprising:

positioning a large bore mobile vacuum system in proximity to a ground tank indicated for cleaning, the large bore mobile vacuum system including a vacuum line having a diameter of at least 8 inches;

attaching a large bore vacuum nozzle to the vacuum line;

connecting a pressurized liquid line to a conduit attached to an outer surface of the large bore vacuum nozzle;

guiding the large bore vacuum nozzle through a tank wall of the ground tank into the ground tank, wherein the vacuum line is physically manipulated by an operator located outside of the ground tank; and using the large bore vacuum nozzle to clean within the ground tank, wherein at least one of liquid material and solid material is removed from within the ground tank using the vacuum line, including controlling a volume of discharge of the pressurized liquid line from a spray jet in fluid communication with the conduit, wherein the spray jet is directed by the large bore vacuum nozzle when the large bore vacuum nozzle is used to clean the ground tank.

2. The method of claim 1, further comprising:

attaching a large bore extension adapter to the large bore vacuum nozzle, wherein the large bore extension adapter and the large bore vacuum nozzle are made of aluminum.

3. The method of claim 1, wherein positioning the large bore mobile vacuum system further comprises:

positioning the large bore mobile vacuum system in proximity to the ground tank using a first vehicle.

4. The method of claim 3, further comprising:

collecting the at least one of the liquid material and the solid material in a first holding tank of the large bore mobile vacuum system.

5. The method of claim 4, further comprising:

draining the at least one of the liquid material and the solid material from the first holding tank into a second holding tank, wherein the second holding tank is mobile.

6. The method of claim 5, wherein the second holding tank is located on a second vehicle.

7. The method of claim 1, wherein using the large bore vacuum nozzle to clean the ground tank further comprises at least one of:

rolling the large bore vacuum nozzle on a surface within the ground tank using a roller attached to the large bore vacuum nozzle; and wiping the surface using a wiper blade attached to the large bore vacuum nozzle.

8. The method of claim 7, wherein the surface is at the tank wall of the ground tank.

9. The method of claim 7, wherein the surface is a foundation of the ground tank.

10. The method of claim 7, wherein the surface is a sediment layer in the ground tank.

11. The method of claim 1, wherein guiding the large bore vacuum nozzle through a tank wall of the ground tank into the ground tank further comprises:

acquiring an infrared image of the ground tank from outside the ground tank; and based on the infrared image, determining a location in the tank wall for guiding the vacuum line through the tank wall.

12. The method of claim 1, wherein the liquid is water.

* * * * *